US010052667B2

(12) United States Patent
Kaneda et al.

(10) Patent No.: US 10,052,667 B2
(45) Date of Patent: Aug. 21, 2018

(54) ULTRASONICALLY CLEANING VESSELS AND PIPES

(71) Applicant: DOMINION ENGINEERING, INC., Reston, VA (US)

(72) Inventors: Sotaro Kaneda, Hokkaido (JP); Jean E. Collin, Chantilly, VA (US); Joshua M. Luszcz, Falls Church, VA (US); Christopher R. Casarez, Arlington, VA (US); Marc A. Kreider, Herndon, VA (US); Robert D. Varrin, Jr., Reston, VA (US); David J. Gross, Bethesda, MD (US)

(73) Assignee: Dominion Engineering, Inc., Reston, VA (US)

( * ) Notice: Subject to any disclaimer, the term of this patent is extended or adjusted under 35 U.S.C. 154(b) by 0 days.

(21) Appl. No.: 14/776,590

(22) PCT Filed: Mar. 14, 2014

(86) PCT No.: PCT/US2014/028664
§ 371 (c)(1),
(2) Date: Sep. 14, 2015

(87) PCT Pub. No.: WO2014/144315
PCT Pub. Date: Sep. 18, 2014

(65) Prior Publication Data

US 2016/0023252 A1 Jan. 28, 2016

Related U.S. Application Data

(60) Provisional application No. 61/787,238, filed on Mar. 15, 2013.

(51) Int. Cl.
*B08B 3/12* (2006.01)
*B08B 7/02* (2006.01)
(Continued)

(52) U.S. Cl.
CPC ..... *B08B 3/12* (2013.01); *B08B 7/028* (2013.01); *B08B 9/02* (2013.01); *B08B 9/08* (2013.01)

(58) Field of Classification Search
CPC .. B08B 3/12; B08B 7/028; B08B 9/08; B08B 9/02
(Continued)

(56) References Cited

U.S. PATENT DOCUMENTS 4,244,749 A 1/1981 Sachs et al.
4,320,528 A 3/1982 Scharton et al.
(Continued)

FOREIGN PATENT DOCUMENTS

CN 200940755 Y 8/2007
EP 0 427 608 A1 5/1991
(Continued)

OTHER PUBLICATIONS

Extended Search Report, including the supplementary Search Report and the Search Opinion, issued for corresponding European Patent Application No. 14764658.2, dated Oct. 24, 2016.
(Continued)

*Primary Examiner* — Nadine G Norton
*Assistant Examiner* — Christopher Remavege
(74) *Attorney, Agent, or Firm* — Pillsbury Winthrop Shaw Pittman LLP

(57) ABSTRACT

A method of cleaning a vessel having deposits on an interior surface includes removably bonding an ultrasonic transducer to an external wall of the vessel and using the ultrasonic transducer to produce ultrasonic energy coupled into the vessel wall such that at least a portion of the ultrasonic energy is transmitted to the interior surface.

5 Claims, 2 Drawing Sheets

(51) Int. Cl.
*B08B 9/02* (2006.01)
*B08B 9/08* (2006.01)

(58) Field of Classification Search
USPC ..... 134/1, 169 R, 22.1, 22.11, 166 R
See application file for complete search history.

(56) References Cited

U.S. PATENT DOCUMENTS

| | | | | |
|---|---|---|---|---|
| 4,762,668 | A | 8/1988 | Loose et al. | |
| 4,832,874 | A | 5/1989 | Nohmi | |
| 5,803,099 | A | 9/1998 | Sakuta et al. | |
| 6,150,753 | A * | 11/2000 | DeCastro | B08B 3/12 310/325 |
| 6,290,778 | B1 | 9/2001 | Zugibe | |
| 6,572,709 | B1 | 6/2003 | Kaneda et al. | |
| 7,867,336 | B2 * | 1/2011 | Zanolli | B08B 9/08 134/1 |
| 2005/0109368 | A1 * | 5/2005 | Goodson | B06B 1/0611 134/1 |
| 2007/0205695 | A1 | 9/2007 | Puskas | |
| 2008/0105625 | A1 * | 5/2008 | Rosenberg | B08B 3/12 210/748.11 |
| 2008/0283084 | A1 * | 11/2008 | Miraglia | B08B 7/028 134/1 |
| 2008/0289971 | A1 * | 11/2008 | Shigihara | A61L 2/025 205/687 |
| 2010/0042389 | A1 * | 2/2010 | Farruggia | B08B 3/12 703/6 |

FOREIGN PATENT DOCUMENTS

| | | | |
|---|---|---|---|
| JP | H02-017284 | | 2/1990 |
| JP | H04-298274 | A | 10/1992 |
| JP | H06-304527 | | 11/1994 |
| JP | H07-198286 | A | 8/1995 |
| JP | 2002-267089 | A | 9/2002 |
| JP | 2005-199253 | A | 7/2005 |
| JP | 2006-519510 | | 8/2006 |
| JP | 2008-062162 | | 3/2008 |
| WO | 2006/001293 | | 7/2008 |

OTHER PUBLICATIONS

First Office Action issued for corresponding Chinese Patent Application No. 201480027718.8, dated Aug. 30, 2016.

Kaneko, M., et al., "Development of High Volume Reduction and Cement Solidification Technique for PWR Concentrated Waste," paper presented at the Waste Management '01 Conference, Feb. 25-Mar. 1, 2001, 7 pages.

Kazymyrovych, V., *Very High Cycle Fatigue of Engineering Materials,* Karlstad, Sweden: Karlstad University Studies, 2009, ISBN 978-91/7063-246-4.

International Search Report and the Written Opinion of the International Searching Authority as issued in International Application No. PCT/US2014/028664, dated Aug. 13, 2014.

Non-Final Office Action issued for corresponding Japanese Patent Application No. 2016-502863, dated Nov. 7, 2017.

* cited by examiner

ULTRASONICALLY CLEANING VESSELS AND PIPES

CROSS-REFERENCE TO RELATED APPLICATION

The present application is the U.S. National Phase of PCT/US2014/028664, filed Mar. 14, 2014, which is based on and claims priority to U.S. provisional application no. 61/787,238 filed on Mar. 15, 2013. The contents of all of these applications are incorporated herein by reference in their entirety.

BACKGROUND

Field of Invention

This invention relates to the use of acoustic energy generated by ultrasonic transducers to clean (or prevent the formation of) deposits that accumulate on the surfaces of pipes, vessels, or other components in industrial systems. More particularly, the invention relates to application of ultrasonic energy to such pipes, vessels or other components using non-permanent bonding between the transducers and the components.

BRIEF SUMMARY OF THE INVENTION

Vessels, piping, and components used in industrial systems to contain and convey liquid and/or vapor are frequently subject to the accumulation of deposits formed through processes such as chemical precipitation, corrosion, boiling/evaporation, particulate settling, and other deposition mechanisms. The buildup of such deposits can have a wide range of adverse consequences, including loss of heat-transfer efficiency, clogging of flow paths, and chemical or radioactive contamination of flow streams or personnel among others. Accordingly, effective removal and/or prevention of such deposits with minimal disruption to the system in which the vessel or piping is situated (e.g., avoiding time-consuming and costly maintenance activities, reducing system downtime, etc.) is frequently a priority for many industrial facility operators.

One such application which has been adversely affected by deposits involves the treatment of radioactive liquid waste produced during operation of a pressurized water reactor (PWR) power plant. PWR plant operators commonly wish to process this liquid waste into a solid form. Methods for creating the solid waste include asphalt solidification (e.g., according to the method described in U.S. Pat. No. 4,832,874) and cement solidification (e.g., according to Kaneko, et al. [1]). The main goals of these processes are to achieve a stable, solid form—that requires less volume than the original liquid—as a means to facilitate safe storage and/or disposal.

Volume reduction in PWR waste solidification processes often involves the use of a wiped-film evaporator as a means to remove water from the waste stream and allow the separated solid waste to be further processed. A typical wiped-film evaporator includes: a) a cylindrical vessel with a vertically oriented axis; b) a heating jacket consisting of a shell that surrounds the vessel, forming an annular region between the vessel and the shell; c) a liquid waste feed pipe which is connected to the upper part of the vessel; d) a central rotating shaft aligned with the axis of the vessel; e) a series of wiper blades attached to the central rotating shaft; f) a vapor extraction pipe disposed at the upper end of the vessel which allows evaporated water from the waste stream to exit the vessel; and g) a solid waste exit pipe disposed at the base of the vessel.

The basic processes by which the wiped-film evaporator operates may be described with the following sequence: 1) liquid PWR waste enters the evaporator through the waste feed pipe, 2) this incoming waste stream comes into contact with the central rotating shaft and, through the rotating action of the shaft, is guided to the inner walls of the vessel, whereupon it descends under the action of gravity; 3) the inner walls of the vessel are heated through contact with pressurized steam or oil contained within the heating jacket; 4) the liquid waste is in turn heated by contact with the vessel inner walls as it descends; 5) the liquid waste reaches its boiling point, creating both steam, which now ascends upward through the vessel, and solid waste deposits, which accumulate on the inner vessel walls; and 6) the wiper blades, attached to the central rotating shaft, liberate the solid waste deposits that have accumulated on the vessel walls, allowing them to descend to the base of the vessel under the action of gravity and then exit the vessel through the waste exit pipe for further processing.

Due to the nature of its essential function—creating solids through boiling—it has been found by some operators that the wiped-film evaporators used in treating PWR liquid waste can be subject to the excessive accumulation of waste deposits on various internal component surfaces in addition to the inner vessel walls. These deposits can adversely affect the heat-transfer characteristics of the evaporator, clog flow paths, and otherwise impede proper functioning of the evaporator and connected piping and equipment.

Accordingly, some means for removing these deposits is required. One method consists of partial disassembly of the evaporator followed by manual removal of the deposits from affected surfaces with hand tools. However, this method tends to be costly and to involve exposure of workers to increased risk of contamination with the radioactive deposits that they are removing from evaporator component surfaces. A second method involves use of water lancing technology. However, this approach typically requires that the evaporator be cleaned offline with labor-intensive activities, generates additional liquid waste due to contamination of the cleaning water, increases the risk of personnel contamination (e.g., through generation of aerosols), and potentially increases equipment downtime. The effectiveness of water lancing is also restricted to those evaporator surfaces to which the water lancing jets have line-of-sight access.

One method which has the potential to overcome line-of-sight restrictions and personnel contamination risks is the use of ultrasonic cleaning technology. Ultrasonic transducers have been used as a means for efficiently removing unwanted deposits from surfaces for many years in a variety of applications. In many cases, these applications involve the use of ultrasonic transducers submerged in a liquid medium, such that acoustic energy is transmitted from the transducers to the liquid medium and then from the liquid medium to the component surface containing the deposit. Examples of this approach include the cleaning of heat exchangers such as shell-and-tube heat exchangers according to the methods and devices described in U.S. Pat. Nos. 4,244,749; 4,320,528; 6,290,778; and 6,572,709 as well as many of the references cited therein. Other examples of ultrasonic cleaning technologies which use the liquid medium to transmit acoustic energy directly to the target surface include applications involving other industrial components or processes such as cleaning of metal parts (e.g., Japanese Publication No. 4-298274(A)) and removing organic films from pipes (e.g., Japanese Publication No. 7-198286).

In many applications, including as an example the wiped-film evaporator for treating liquid PWR waste described above, the inner surfaces of vessels or pipes are not readily accessible for installing conventional ultrasonic cleaning systems, making it difficult and/or impractical to directly convey acoustic energy from an ultrasonic transducer through a liquid medium within the vessel or pipe (and then to the surface containing the deposits to be cleaned). Also, as described earlier for the wiped-film evaporator, cleaning during operation of the system (i.e., "online cleaning") is desired to minimize equipment downtime, again making it difficult or impractical to deploy transducers which transmit acoustic energy to a liquid medium and then to the deposit-containing surfaces inside vessels such as the wiped-film evaporator vessel. In addition, the fluid inside the vessel may be two-phase (steam and liquid), rendering it difficult to transmit acoustic energy from transducers located within the vessel to the target surfaces.

Prior art instructs that the use of ultrasonic transducers external to the vessel, pipe, or component surface is an option for online cleaning applications. Specifically, U.S. Pat. No. 4,762,668 describes an ultrasonic device for the online cleaning of venturi flow nozzles mounted in a pipe. That patent describes the mounting of multiple ultrasonic transducers on the external surface of the pipe, with the resonator of each ultrasonic transducer placed in contact with the outer surface of the venturi nozzle (located concentrically within the pipe) through spring loading.

A second example of prior art relating to the use of external transducers is Japanese Patent Publication No. 2005-199253, which describes an invention involving an externally mounted ultrasonic transducer capable of producing uniform acoustic fields in the liquid contained within a tubular container (such as a pipe) and thereby increase the efficiency of liquid processing within the tubular container (e.g., emulsification, chemical reactions, wastewater treatment). This invention describes attachment of the ultrasonic transducer to the pipe with a clamp that is tightened with threaded connections such as screws or bolts.

The inventions described in both U.S. Pat. No. 4,762,668 and Japanese Patent Publication No. 2005-199253 rely on surface-to-surface contact between the resonator of the transducer and the exterior wall of the component through which ultrasonic waves are to be transmitted. Due to the inherent unevenness of even carefully polished surfaces, the actual area of contact between the resonator and the component is typically very small, limiting the efficiency with which ultrasonic energy can be delivered to the target component. Additionally, friction between the in-contact surfaces generates heat, further limiting the transmission efficiency. These reductions in transmission efficiency require that additional energy be input to the ultrasonic transducer, potentially making ultrasonic solutions impractical, particularly in cases where the component wall thickness is large. Also, reliance on surface-to-surface contact for the transmission of ultrasonic energy can unpredictably alter the dynamic characteristics of the transducer/component system. Such unpredictability can be a problem in applications where the stresses induced in the target component by the ultrasonic application must be limited to ensure long-term component integrity. This is particularly important in view of recent research that has shown that most materials do not exhibit a fatigue limit (i.e., a stress state at which an unlimited number of cyclic loadings may be applied without resulting in fatigue failure of the component) (see, Kazymyrovych, [2]).

Some other methods of attaching the transducer resonator to the exterior wall, such as threaded connections (e.g., bolts), also rely on surface-to-surface contact and therefore suffer the same problems with reduced transmission efficiency. Further, such methods require permanent modifications to the exterior wall of the vessel or component to facilitate attachment.

Existing methods to overcome the limitations associated with surface-to-surface contact as a means of transmitting ultrasonic energy include welding and brazing. The development of magnetostrictive materials to generate ultrasonic energy in the 1950s and 1960s led to applications in which the transducer is bonded to the target surface through welding or brazing. However, in certain applications, these attachment methods require significant heat input to the target component, which can alter the metallurgical properties, stress state, and/or dimensions of the component. Such changes may be undesirable in certain applications, where, for example, changes in the stress field induced by welding must be qualified as acceptable through costly analysis and/or inspection techniques. In other applications, the geometrical distortion induced by welding or brazing may lead to interferences or otherwise render the equipment nonfunctional. Further, the use of welding in particular makes the transducer installation permanent in the sense that major alterations to the component must be carried out to remove the transducer. Lastly, the use of weld modifications to industrial components frequently involves extensive field procedures as well as time-consuming and costly operator and/or component vendor approval processes.

Another alternative method to overcome the limitations of surface-to-surface contact is the use of conventional adhesives. Such adhesives are used to mount ultrasonic transducers for a variety of applications. However, these adhesives may not be suitable for all applications requiring external transducer mounting due to the dynamic material properties of the adhesives (including a relatively low structural stiffness), long-term changes in these properties after exposure to vibration, and/or temperature limitations associated with the adhesive material.

Aspects of embodiments of the present invention may include methods by which one or more ultrasonic transducers, which may include (but are not limited to) those containing piezoceramic active elements, may be bonded to the external surface of a component with a non-permanent means that is capable of transmitting acoustic energy through the component wall, and thereby inducing both vibration of the component wall and cavitation within a liquid on the opposite side of the component wall, more efficiently than with surface-to-surface contact in the absence of the non-permanent bond. The non-permanent bonding method associated with the current invention may be installed and removed without the heat input, geometrical distortion, or change in stress state associated with welding or brazing.

BRIEF DESCRIPTION OF THE DRAWINGS

An example embodiment of the methods that may be utilized in practicing the invention are addressed below with reference to the attached drawings in which.

It should be noted that these figures are intended to illustrate the general characteristics associated with an example embodiment of the invention and thereby supplement the written description provided below. These drawings are not, however, to scale, may not precisely reflect the characteristics of any given embodiment, and should not be interpreted as defining or limiting the range of values or properties of embodiments within the scope of this invention.

DESCRIPTION OF AN EXAMPLE EMBODIMENT

Figure 1:
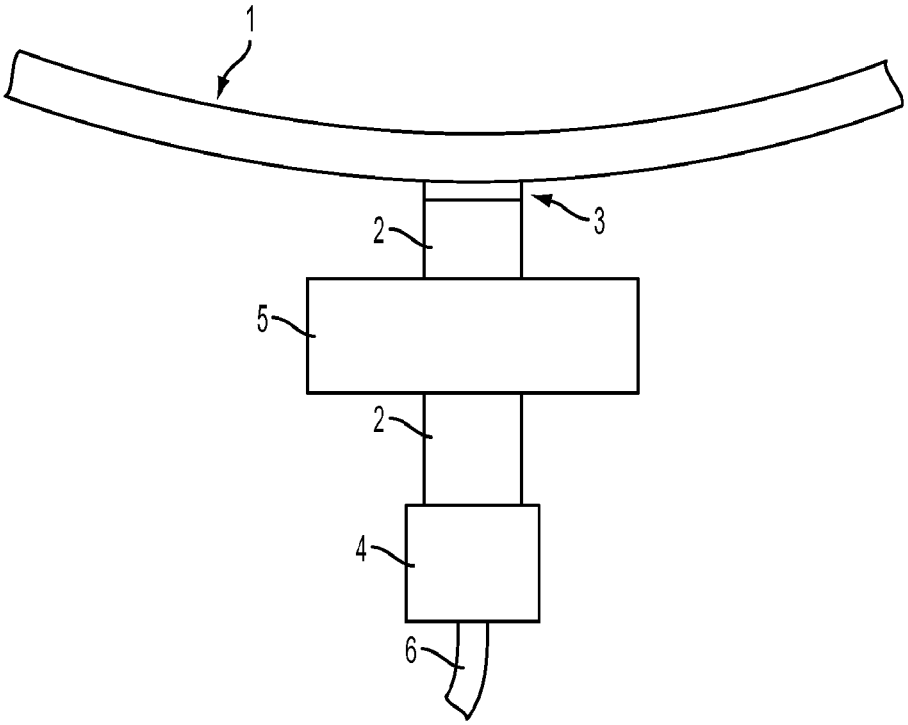
FIG. 1 illustrates an example embodiment in accordance with the invention as applied to a vessel such as that associated with a wiped-film evaporator.

An embodiment in accordance with aspects of the current invention is illustrated in FIG. 1. The figure shows the resonator 2 of an ultrasonic transducer connected to a vessel wall 1 with a non-permanent bond 3. Also shown is a structural support 5 which applies a compressive loading to the non-permanent bond 3 against the vessel wall 1. The active transducer element 4 and ultrasonic signal connection 6 are also illustrated in this example embodiment. The non-permanent bond 3 may be selected to provide sufficient coupling to allow transmission of the ultrasonic energy from the transducer into the vessel. Furthermore, the bond may be selected such that it is removable without significant damage to the vessel wall. In this regard, the bond may be formed from a material that is structurally weaker than the vessel wall, making it selectively frangible.

One or more embodiments of the invention may employ ultrasonic transducers, including (but not limited to) those with piezoceramic active elements, which operate at frequencies of between 10 kHz and 140 kHz or more. The transducer may be configured and arranged to produce varying frequencies and/or ranges of frequencies (i.e., broadband or narrow-band rather than single band signals).

One or more embodiments of the invention may be used at elevated temperatures up to and in some cases above the operating temperatures of target systems such as wiped-film evaporators (e.g., above 100° C.).

One or more embodiments of the invention may be used to efficiently transmit acoustic energy through thick-walled components (e.g., at least 10 mm)

In one or more embodiments of the invention, the efficacy and/or reliability of the non-permanent bonding method may be enhanced through continuous compressive loading of the bond. Such loading may be produced by way of mounting hardware, actuators, and/or other structural components configured and arranged to bias the transducer toward the surface of the vessel, thereby compressing the bond.

In one or more embodiments of the invention, a plurality of ultrasonic transducers may be deployed as a single system on a vessel or component. The plurality of transducers may operate at independent frequencies and/or powers, may be jointly driven, and/or may be employed as a parametric array to generate targeted constructive and/or destructive interference effects.

One or more embodiments of the invention may operate continuously or intermittently without manual intervention by system operators. In embodiments, the cleaning process may be performed while the system or vessel is in use, while in alternate approaches, it may be performed during a pause in operations.

Figure 2:
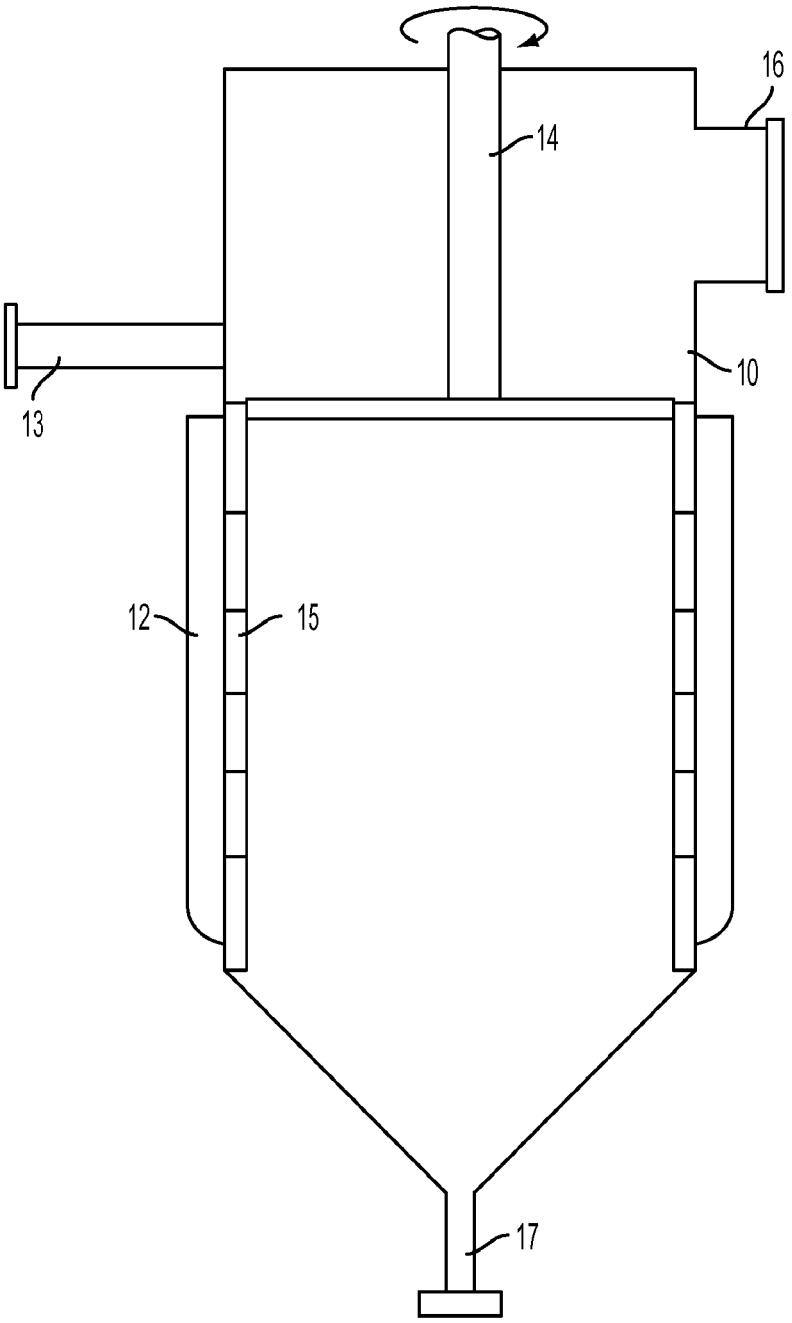
FIG. 2 illustrates a typical wiped film evaporator used to isolate solid waste products from a liquid waste stream.

Embodiments of the current invention may be applied to the vessels of wiped-film evaporators used for treating liquid PWR waste. A typical wiped-film evaporator is shown in FIG. 2, with cylindrical vessel 10, heating jacket 12, liquid waste feed pipe 13, central rotating shaft 14, wiper blades 15, vapor extraction pipe 16, and solid waste exit pipe 17. However, the applicability of the invention is not limited to wiped-film evaporators. Those skilled in the art will recognize the potential use of the invention with various vessels, piping, and components in assorted industrial applications related to power generation and the chemical process industry.

Embodiments of the current invention may involve non-permanent structural support from existing structures on the exterior of the target vessel, such as a flanged connection.

REFERENCES CITED

1. Kaneko, M., M. Toyohara, T. Satoh, T. Noda, N. Suzuki, and N. Sasaki,

"Development of High Volume Reduction and Cement Solidification Technique for PWR Concentrated Waste," paper presented at the Waste Management '01 Conference held in Tucson, Ariz., Feb. 25-Mar. 1, 2001.

2. Kazymyrovych, V., Very High Cycle Fatigue of Engineering Materials, Karlstad, Sweden: Karlstad University Studies, 2009. ISBN 978-91-7063-246-4.

We claim:

1. A method of cleaning a thick-walled vessel having deposits on an interior surface thereof, comprising:

removably bonding an ultrasonic transducer to an external wall of the vessel without geometrical modification of the external wall with a material that is structurally weaker than a material of the external wall of the vessel;

using a structural support to bias the transducer towards the surface of the vessel to continuously apply a compressive load to the removable bond; and using the ultrasonic transducer to produce ultrasonic energy coupled into the vessel wall such that at least a portion of the ultrasonic energy is transmitted to the interior surface.

2. A method as in claim 1, wherein the transmitted portion of the ultrasonic energy is applied over a time and at a power density sufficient to effect removal of at least a portion of the deposits.

3. A method as in claim 2, wherein at least 50% of the deposits are removed.

4. A method as in claim 1, wherein the ultrasonic energy is in a frequency range between 10 kHz and 140 kHz.

5. A method as in claim 1, wherein the removably bonding comprises bonding the ultrasonic transducer to the vessel with a material that is selected to be capable of being installed and removed without geometrical distortion or change in stress state of the external wall.

* * * * *